United States Patent [19]

Okado

[11] 4,260,948

[45] Apr. 7, 1981

[54] METHOD AND APPARATUS FOR CONTROLLING ELECTRIC VALVES IN AC POWER SUPPLY

[75] Inventor: Chihiro Okado, Fuchu, Japan

[73] Assignee: Tokyo Shibaura Denki Kabushiki Kaisha, Kanagawa, Japan

[21] Appl. No.: 14,475

[22] Filed: Feb. 23, 1979

[30] Foreign Application Priority Data

Feb. 28, 1978 [JP] Japan ..... 53-22579
Feb. 28, 1978 [JP] Japan ..... 53-22580

[51] Int. Cl.[3] ..... G05F 1/44
[52] U.S. Cl. ..... 323/241; 307/252 T
[58] Field of Search ..... 323/22 SC, 24, 25, 34; 307/252 T

[56] References Cited

U.S. PATENT DOCUMENTS 3,610,961 10/1971 Hewlett, Jr. ..... 323/34 UX
3,665,293 5/1972 Keiler et al. ..... 323/24
3,693,069 9/1972 Kelley, Jr. et al. ..... 323/34 X
3,936,726 2/1976 Kelley, Jr. ..... 323/24

*Primary Examiner*—William M. Shoop
*Assistant Examiner*—Peter S. Wong
*Attorney, Agent, or Firm*—Stevens, Davis, Miller & Mosher

[57] ABSTRACT

In a method and apparatus for controlling an AC power supply from a power source to a load having a considerably large inductance through electric valve means, the ignition phase angle of the valve means is limited to a value greater than the angle of the power factor. The limiting value is calculated for each cycle based on the power source voltage and a turn-off period of the valve means in the cycle immediately preceding the aforementioned cycle.

According to this invention, it is possible to automatically control the ignition of the electric valves over the entire cycle.

4 Claims, 9 Drawing Figures

METHOD AND APPARATUS FOR CONTROLLING ELECTRIC VALVES IN AC POWER SUPPLY

BACKGROUND OF THE INVENTION

This invention relates generally to an electric power supplying technique, and more particularly to an AC power supply controlling method and device wherein the load current supplied from an AC power source to a load containing a substantial amount of inductance is controlled by means of electric valves.

Where an electric power is supplied from an AC power source to a load such as a welding machine having a lagging power factor, the load current is ordinarily controlled by a control system as shown in FIG. 1 of the accompanying drawings. In FIG. 1, a load current supplied from an AC power source 1 and flowing through a load containing a resistance 3 and an inductance 4 is controlled by electric valves 2, such as thyristors and the like, which are connected in parallel opposition. The ignition of the electric valves 2 is effectuated by an output gate signal $V_G$ delivered from a phase controlled 6. The phase controller 6 is operated by a synchronizing pulse signal picked up from the power source through a transformer 5. Within the phase controller 6, a capacitor 9 is charged through an adjustable (semi-fixed) resistor 7 and a variable resistor 8. When the charging voltage exceeds a predetermined value, a unijunction transistor 10 is turned on, thus energizing a pulse transformer 11. The pulse transformer 11 thus delivers from its secondary winding the aforementioned gate pulse $V_G$ which is applied to the electric valves. In the above described conventional arrangement, the resistor 7 has been manually adjusted so that the phase angle of the gate pulses $V_G$ for igniting the electric valves is always lagging from the angle of the power factor regardless of the control of the variable resistor 8. Once the resistor 7 is set as described above, the ordinary phase controlling operation of the load current can be achieved satisfactorily by adjusting the variable resistor 8.

However, where the power factor of the load is approximately zero as in a case where the load comprises a pure inductance, the control of the power supply becomes difficult. The reason will now be described with reference to FIGS. 2*a* and 2*b*.

In FIG. 2*a*, there are indicated a series of gate pulses $V_G$, each igniting the electric valves 2 at an instant $t_1$, and also the output voltage $V_O$ and the output current i flowing through the electric valves which are conducting throughout one-cycle of the power source voltage. As is apparent from the drawing, since a DC transient component always exists although not shown in the drawing, the conduction of the electric valves for the entire one-cycle period can be obtained only when the phase angles of the gate pulses $V_G$ for igniting the electric valves are made different from one cycle to other cycles.

In FIG. 2*b*, waveforms of the output voltage $V_O$ and the output current i are indicated for a case where the ignition phase angle of the electric valves is lagging from that of the power factor. In this case, since the DC component will be attenuated within about one half-cycle period, a symmetrical waveform of the current can be obtained by successive ignitions of the electric valves at a constant phase angle.

However, if the electric valve is ignited at a phase angle leading that of the power factor, the control of the electric valve tends to become discontinuous and uncontrollable because of the existence of the DC transient component. That is, there is always an angular range wherein the control becomes impossible.

For this reason, in the conventional control device as shown in FIG. 1, the adjustable resistor 7 has been manually readjusted each time the power factor varies so that the phase angles of the gate pulses will never lead the angle of the power factor regardless of the variation of the variable resistor 8 for the phase control of the load current.

In other words, in the case where a plurality of loads such as welding machines, the power factor of which widely varies depending on its load, are connected to the conventional power supply, it has been an ordinary practice that the ignition phase angle of the electric valve is manually limited to a value lagging from that of the power factor, thus limiting the use of the power supply in a reduced output condition. Such a procedure narrows the controllable range of the power supply apparatus, and the utilization factor of the same is thereby lowered.

SUMMARY OF THE INVENTION

A primary object of the present invention is to provide an electric power supply controlling method and apparatus wherein the above described shortcomings of the prior art can be substantially eliminated.

According to one aspect of the present invention, ther is provided a method for controlling AC power supplied from an AC power source through controllable electric valve means to a load having a substantial amount of inductance, the method comprising the steps of calculating a limiting value of a phase angle to ignite the electric valve means for a specific cycle of the power source voltage based on the power source AC voltage and the turn-off period of the electric valve means in the immediately preceding cycle of said specific cycle, and limiting the actual phase angle for controlling the electric valves in said specific cycle to said limiting value.

In another aspect of the present invention, there is provided an apparatus for controlling the AC power supply from an AC power source through controllable electric valves to a load having a substantial amount of inductance, the apparatus comprising means for calculating a limiting value of a phase angle for igniting the electric valves in a specific cycle of the power source voltage based on the power source AC voltage and a turn-off period of the electric valves in the immediately preceding cycle of the specific cycle, and means for limiting the actual phase angle for controlling the electric valves in the specific cycle to the limiting value.

DESCRIPTION OF THE PREFERRED EMBODIMENTS

Figure 3:
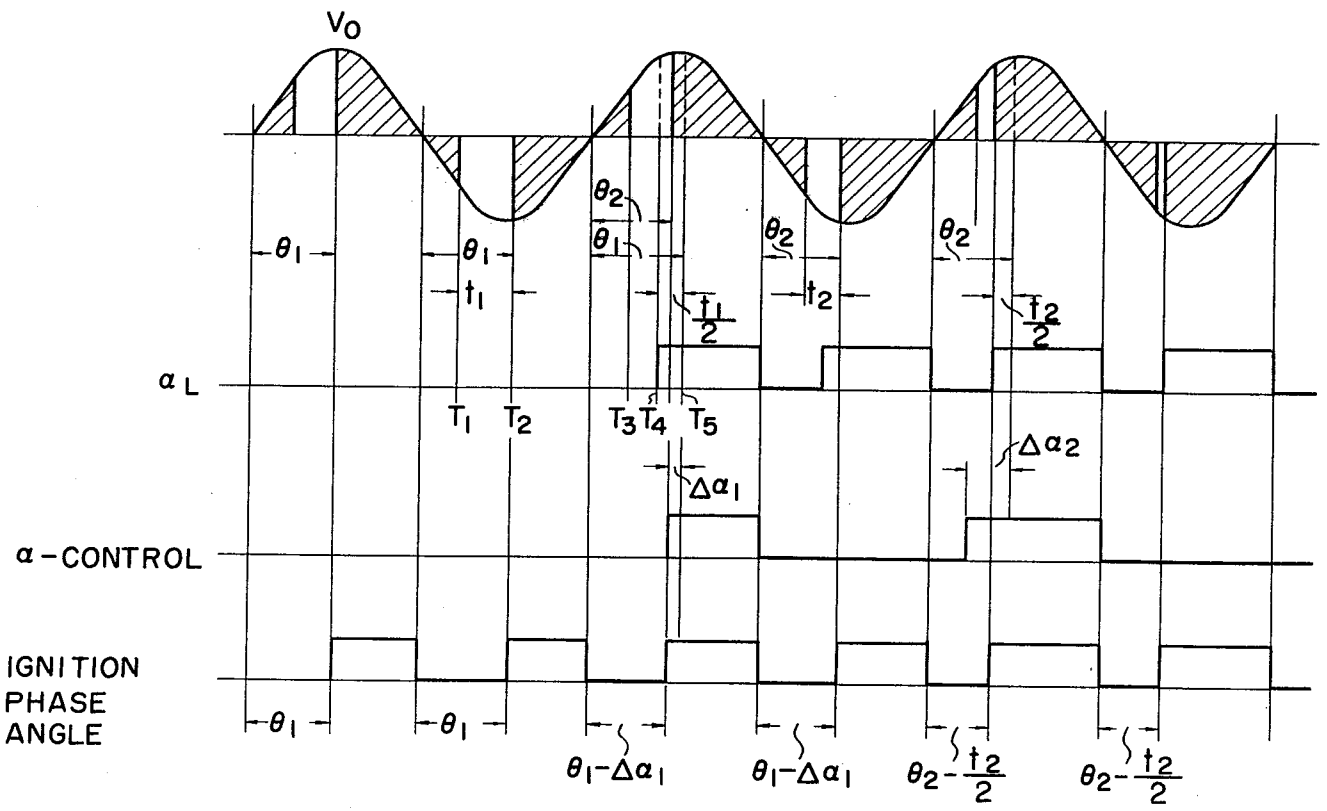
FIG. 3 is a waveform diagram for explaining a controlling method according to this invention.

Referring now to FIG. 3, a method for controlling the electric valve will now be described. Herein it is assumed that the ignition phase angle is held constant during each cycle of the AC power source voltage, but is differentiated from one cycle to the other. It is further assumed that the ignition phase angles for the two electric valves in a specific cycle of the power source voltage are selected to be $\theta_1$ which is lagging from the angle of the power factor and that turn-off period at that time of each electric valve during the same cycle is equal to $t_1$. Then the limiting phase angle $\alpha_L$ for a cycle immediately following the specific cycle, in which can conduct each electric valve throughout one-cycle period at power factor of $\cos\phi \approx 0$, can be expressed as $$\alpha_L = \theta_1 - \tfrac{1}{2} t_1 \quad (1)$$

That is, in the case of $\cos\phi \approx 0$, an advance of the ignition angle of $\frac{1}{2}$ $t_1$ retards the turn-off point of the electric valve by $\frac{1}{2}$ $t_1$, and hence the electric valve is brought into conductive state throughout one-cycle period (hereinafter termed fully conductive state).

In the case where $\cos\phi > 0$, the fully conductive state cannot be obtained as early as in the following cycle as described above. However, a state substantially equal to that can be attained after several cycles by igniting the electric valves under the above described limitation.

Otherwise, the limiting phase angle can be expressed as $$\alpha_L = \theta_1 - \tfrac{1}{2} k t_1 \ (k > 1) \quad (2)$$

wherein, k is a function of $\cos\phi$. In this case, the fully conductive state can be attained earlier than in the above described case, although the calculation of this relation is far more complicated than in the relation (1).

An ordinary phase control of a load current (hereinafter termed $\alpha$-control) is thus carried out by varying the ignition angle of the cycle immediately following the specific cycle to, for instance, $\theta_1 - \Delta\alpha_1$, while the $\alpha$-limit angle in that cycle is selected as $\alpha_L = \theta_1 - \frac{1}{2}$ t as described above.

For the second following cycle of the power source voltage, the limiting phase angle $\alpha_L$ (hereinafter termed $\alpha$-limit) is expressed as $\theta_2 - \frac{1}{2}$ $t_2$ wherein $\theta_2 = \theta_1 - \Delta\alpha_1$, and the $\alpha$-control angle is expressed as $\theta_2 - \Delta\alpha_2$.

In the case where $\Delta\alpha_2$ greater than $\frac{1}{2}$ $t_2$ is selected, the acutal ignition angle is limited to the $\alpha$-limit value of $\theta_2 - \frac{1}{2}$ $t_2$.

It is found that, by the above described control, the fully conductive state can be substantially attained after about three cycles regardless of the amount of the power factor. In an extreme case where the power factor is as high as $\cos\phi = 1$, and where the electric valve is initially ignited at $\theta_1 = 90°$, the $\alpha$-limit $\alpha_L$ is reduced in accordance with the equation (1), in the second cycle to 45°, in the third cycle to 22.5°, and in the fourth cycle to approximately 11°, and from this cycle on, the output is more than 95% of that in the case of the fully conductive state.

Figure 4:
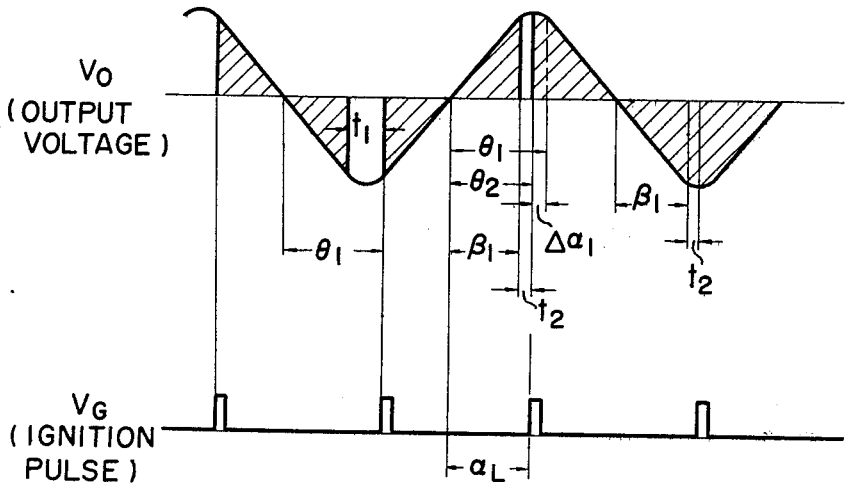
FIG. 4 is a waveform diagram for explaining a modification of the controlling method.

Alternatively, the method for controlling the power supply may also be carried out as follows. It is further assumed that the turn-off phase angle of the electric valve in a specific cycle measured from the zero point of the power source voltage is $\beta_1$ as shown in FIG. 4. Then the turn-off period $t_2$ in the immediately following cycle of the power source voltage can be expressed as $t_2 = \alpha_L - \beta_1$ where $\alpha_L$ is the $\alpha$-limit angle as described above. Thus, a relation $$t_2 = (\theta_1 - \beta 1)/2 \quad (3)$$

may also be applied for an appropriate control of the electric valves. In other words where the power factor is $\cos\phi \approx 0$, if the turning-on instant of the electric valve is advanced by a specific amount, the turn-off instant of the same cycle is delayed for the same specific amount, and the hereinbefore described fully conductive state of the electric valve can be obtained when the equation (3) is satisfied.

In the case where the angle of the power factor is smaller than 90°, the relation may be modified as in the case of equation (2) to, $$t_2 = (\theta_1 - \beta_1)/n \quad (4)$$

wherein n is a function of the power factor, which is greater than 2. Utilizing the relation (4), the fully conductive state of the electric valve can be attained earlier than the case utilizing the equation (3). However, in the case also the construction of the controlling device becomes complicated to an untolerable extent.

Figure 1:
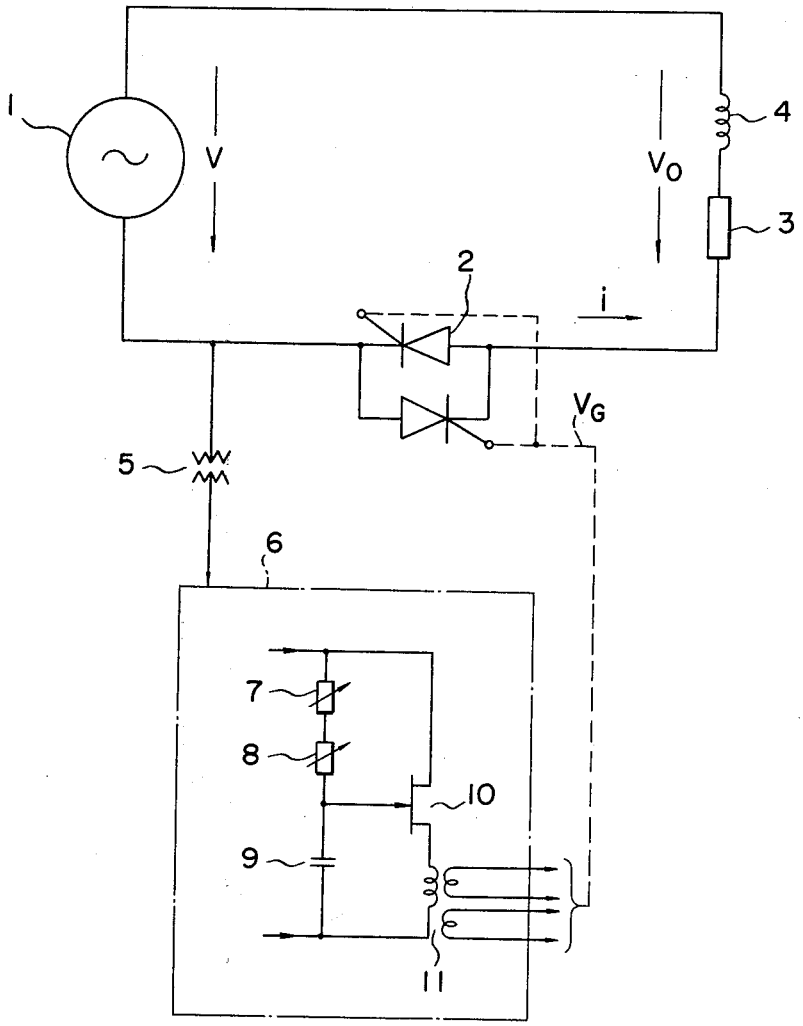
FIG. 1 PRIOR ART
FIG. 1 is a connection diagram showing a conventional AC power controlling device.
Figure 2A:
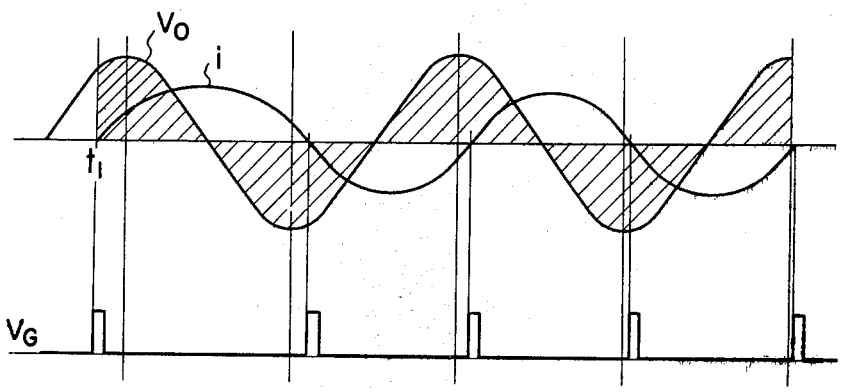
FIGS. 2*a* and 2*b* are waveform diagrams for explaining the necessity of limiting ignition phase angle of electric valves in the device shown in FIG. 1.
Figure 2B:
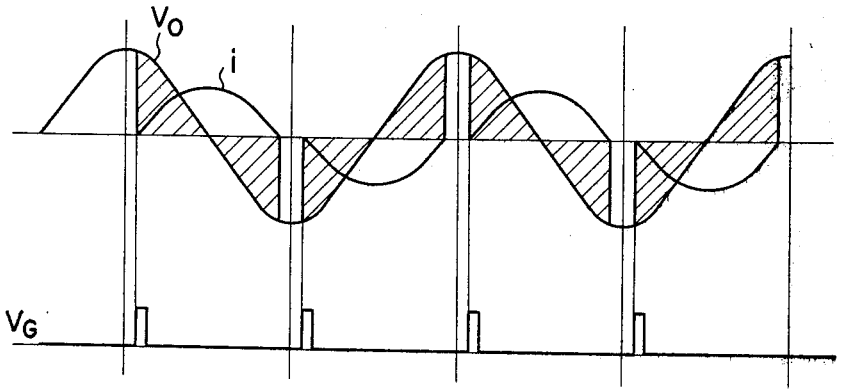

A device for practicing the above described controlling method of the electric valve utilizing the equation (1) will now be described with reference to FIG. 5 wherein like parts as in FIG. 1 are designated by like reference numerals.

In this device, a voltage detector 21 is provided for detecting the voltage across electric valves 2, while the phase angle of the power source voltage is detected by a transformer 5. A phase detecting circuit 22 is provided for receiving the outputs of the voltage detector 21 and the transformer 5 and for delivering a voltage $V_{AC}$ representing the power source phase angle and a voltage $V_{SCR}$ representing the turn-off period (hereinafter termed residual control angle) of the electric valve to a logic circuit 23. The logic circuit thus delivers logic signals a, b, c, and d.

The logic signals close the corresponding contacts in two resistor circuits including resistors such as R and R/2 and connected between two constant voltages +V and −V. Integrators 31 and 41 are provided for integrating the outputs from the resistor circuits respectively, and the outputs from the integrators 31 and 41 are applied to comparators 32 and 42, respectively. The output of the comparator 32 is applied to one input of an AND gate circuit 33, the output of which is applied to a pulse amplifier 34. The output $V_{G1}$ of the pulse amplifier 34 is directly applied to the phase control gate electrode of one of the electric valves 2, while the output $V_{G2}$ of the pulse amplifier 43 is directly applied to the gate electrode of the other electric valve 2.

A current transformer 35 is provided for detecting the load current of the AC power supplying circuit, and the output of the current transformer 35 is applied to an effective value converter 36. The output of the effective value converter 36 is compared with the output of a reference value setting device 37, and the difference is amplified by an amplifier 38, the output of which is applied to a phase control device 39. The output of the transformer 5 is also applied to another input of the phase control device 39 and the output of the device 39 is applied to another input of the aforementioned AND gate circuit 33.

The operation of the device for controlling the power supply will now be described with reference to FIGS. 5 and 6. When the output signals a and b are delivered from the logic circuit 23, corresponding contacts are closed in the first resistor circuit thus applying the constant voltages $+V$ and $-V$ through the resistors R and R/2, respectively, to the input of the integrator 31. The integrating rate in the output voltage $V_2$ from the integrator 31 is different between the above described two cases where the constant voltages are applied through the resistors R and R/2. That is, the varying rate of the signal $V_2$ for the case connecting the resistor R/2 is twice that of the case where the resistor R is connected. Thus when the integrator 31 integrates a signal obtained at the time of the signal b closing the corresponding contact, a calculation of $\frac{1}{2}$ $t_1$ in the equation (1) is made possible. Since the calculation is started at an instant of $\theta_1-t_1$ as shown in FIG. 3, $\alpha_1=\theta_1-t_1+\frac{1}{2}t_1=\theta_1-\frac{1}{2}t_1$ of the equation (1) is obtained as the output $V_2$ of the integrator 31. The output $\alpha_L$ is converted into a logic signal in the comparator 32 which compares the input $\alpha_L$ with a zero level.

The AND gate circuit 33 delivers a logic product of the $\alpha_L$ and the output $\alpha$ obtained from the phase control device 39, toward an electric valve through the pulse amplifier 34 thus enabling to limit the phase angle $\alpha$ to the limiting valve of $\alpha_L$.

Figure 7:
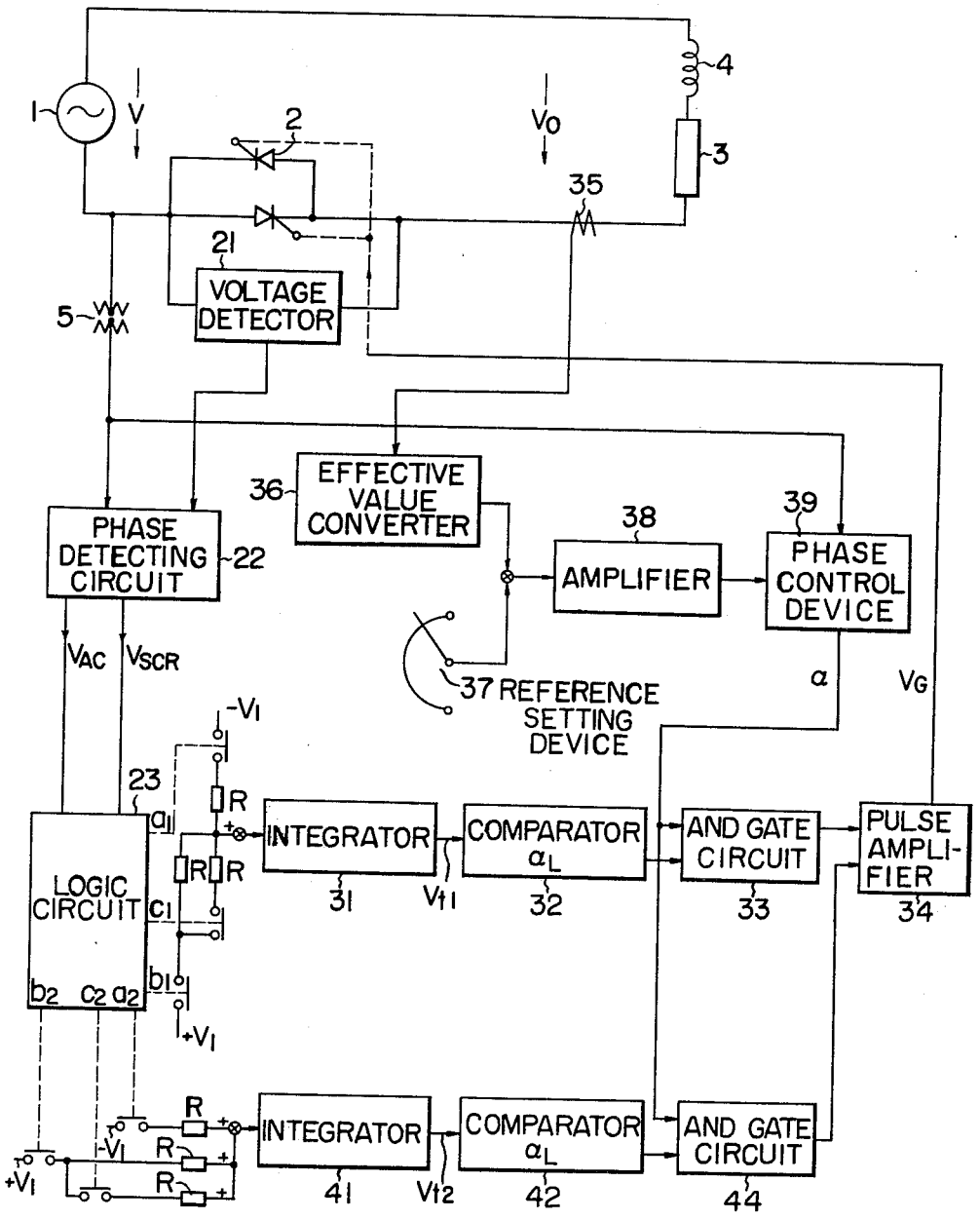
FIG. 7 is a block diagram showing another example of the electric power supply controlling apparatus according to this invention.

On the other hand, the integrator 41 memorizes the period where the contact c, corresponding to the signal c obtained from the logic circuit 23 is held closed, and at an instant of closing the contact d, the memorized period is read out by the integrator 41, and is formed into a logic signal by the comparator 42. The logic signal is then amplified by the amplifier 43 into an ignition signal $V_{G2}$. The ignition signal $V_{G2}$ is applied to the phase control gate electrode of the other electric valve. In FIG. 7, there is illustrated another power supply controlling device utilizing the hereinbefore described equation (3). In this drawing, like parts as in FIG. 5 are designated by like reference numerals.

Figure 5:
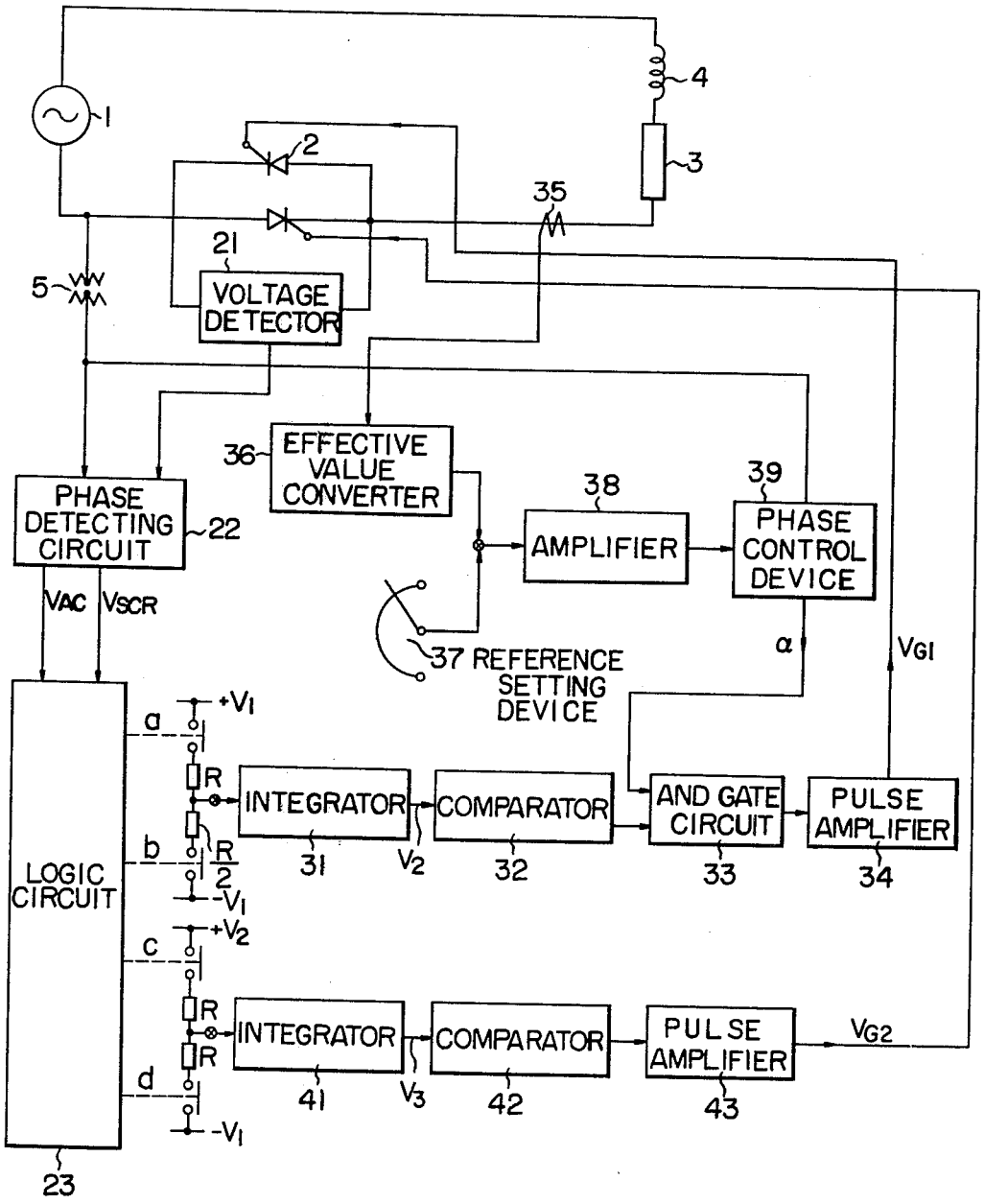
FIG. 5 is a block diagram showing an example of an electric power supply controlling apparatus according to this invention.
Figure 6:
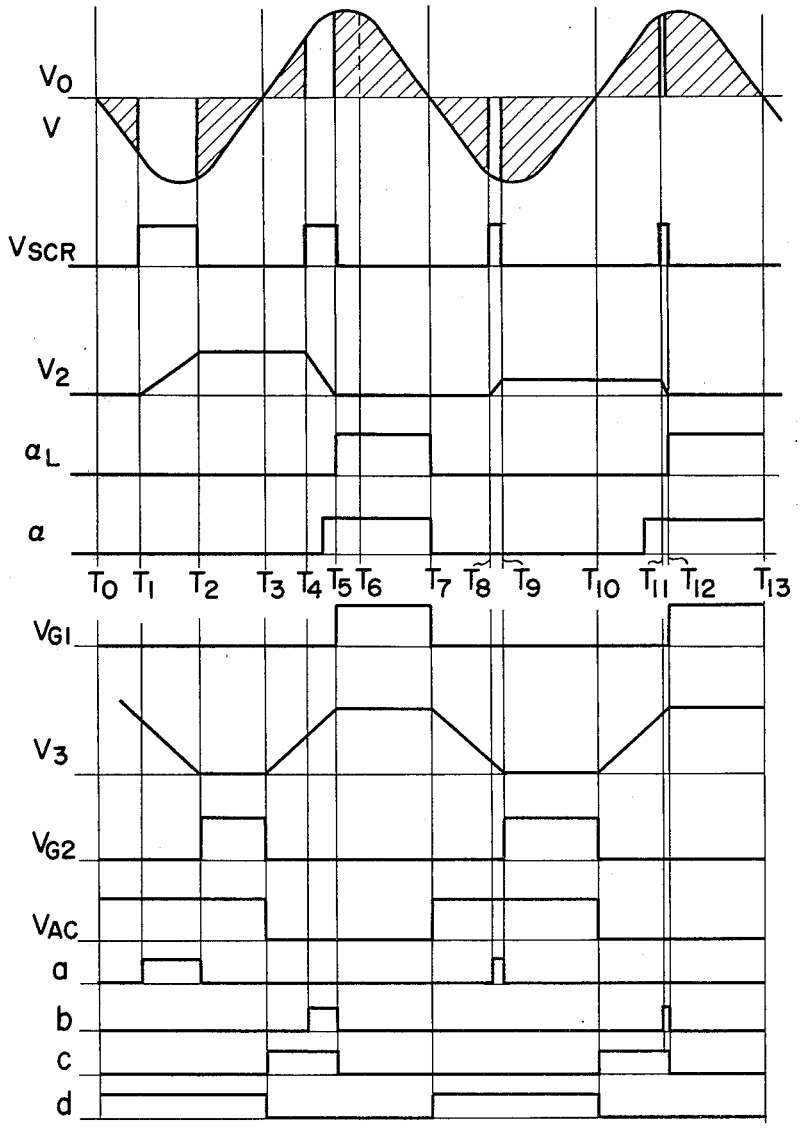
FIG. 6 is a diagram showing waveforms of various parts in the apparatus shown in FIG. 5.

In this device, a voltage detector 21 and a transformer 5 are provided as in the example shown in FIG. 5, thereby providing voltages $V_{AC}$ and $V_{SCR}$ as the output of a phase detecting circuit 22. These voltages are applied to a logic circuit 23 which delivers output signals a1, b1, c1, and a2, b2, c2. The signals a1, b1, and c1 open or close corresponding contacts in a first resistance circuit including resistors R connected between two constant voltages $+V_1$ and $-V_1$. Likewise the signals a2, b2, and c2 open or close corresponding contacts in a second resistance circuit including resistors R connected between the two constant voltages $+V$ and $-V$.

The voltage picked up from the first resistance circuit is applied to an integrator 31, while the voltage picked up from the second resistance circuit is applied to another integrator 41.

The output of the integrator 31 is applied to an input of a comparator 32, another input of which is held at zero level, while the output of the integrator 41 is applied to an input of a comparator 42 having another input held at a zero level. The outputs of the comparators 32 and 42 are connected to one inputs of AND gate circuits 33 and 44 respectively, and the outputs of the AND gate circuits 33 and 44 are both applied to a pulse amplifier 34. The output $V_G$ of the pulse amplifier 34 is applied to the phase controlling gate electrodes of the electric valves 2.

A current transformer 35, an effective value converter 36, reference value setting device 37, an amplifier 38, and a phase control device 39 are provided in a manner similar to those shown in FIG. 5, and the output of the phase controlling device 39 is connected to another input of the AND gate circuit 33 and also to another input of the AND gate circuit 44.

The operation of the device shown in FIG. 7 will now be described with reference to FIG. 8.

Figure 8:
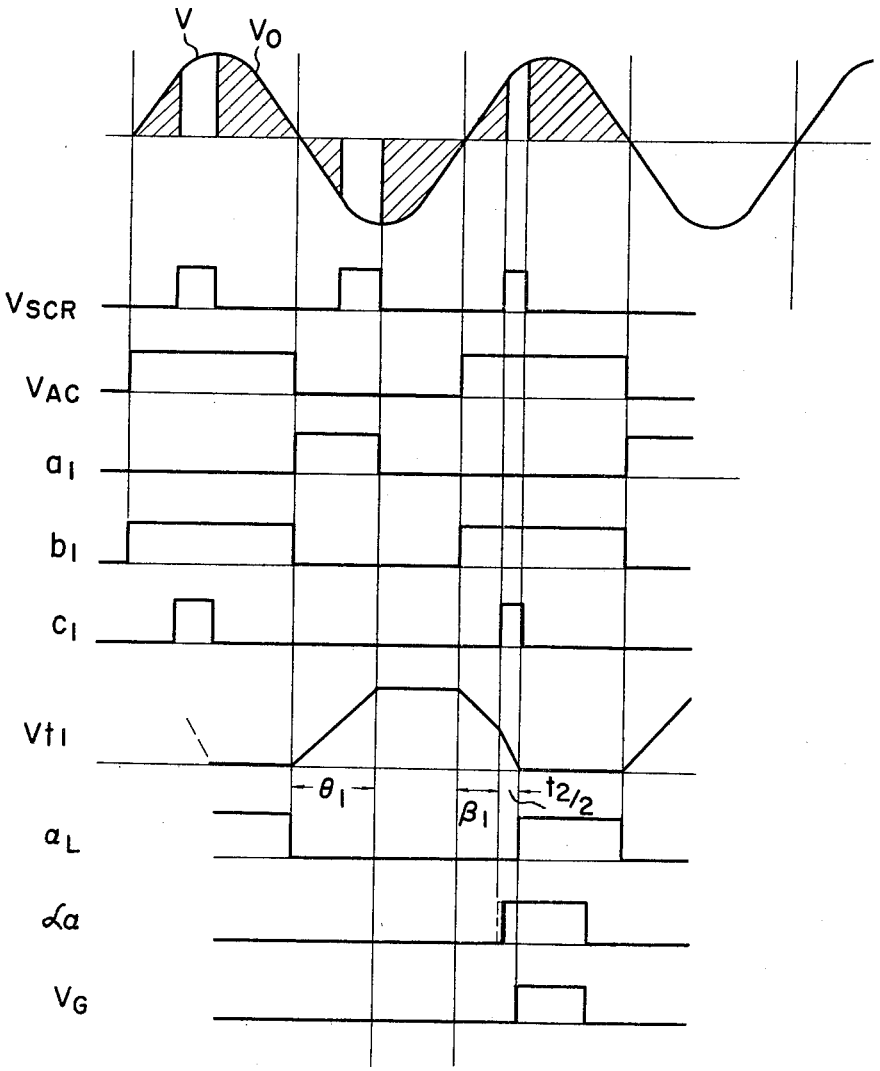
FIG. 8 is a diagram showing waveforms of various parts in the apparatus shown in FIG. 7.

When the contacts in the first resistance circuit are closed by the output signals a1, b1, and c1, the integrator 31 calculates a signal $V_{t1}$ showing a relation $\theta_1-\beta_1-2t_2=0$ corresponding to equation (3) as is apparent from FIG. 8. From this relation the value of $t_2$, and therefore $\alpha$-limit $\alpha_L$ are obtained.

Likewise in the integrator 41, the same relation is calculated for obtaining the $t_2$ and also the $\alpha$-limit $\alpha_L$ with 180° phase difference from that obtained from the integrator 31. The AND gate circuits 33 presents a logic product of the output of the comparator 32 and the ordinary phase control angle $\alpha$ from the phase controlling device 39, while the AND gate circuit 44 presents a logic product of the output of the camparator 42 and the phase control angle $\alpha$. Thus the electric valves can be ignited by the resultant signal $V_G$ obtained from the pulse amplifier 34 which amplifies these two logic products.

Although the invention has been described as calculating the equations (1) or (3), it is apparent that various modification may be carried out in the equations and also in the circuitries of the devices for practicing the invention. For instance, the equation (1) may be modified to $\alpha_L=\theta_1-(1/n)\,t_1$, wherein $n\leqq 2$, or the equation (3) may be modified to $t_2=(\theta_1-\beta_1)/n$ wherein $n\geqq 2$.

I claim:

1. A method for controlling AC power supplied from an AC power source to a load having a substantial amount of inductance through electric valve means, said method comprising the steps of calculating a limiting value $\alpha_L$ of a phase angle for igniting the electric valve means in a specific cycle of power source voltage from the following equation based on the power source voltage and a turn-off period of the electric valves in an immediately preceding cycle of said specific cycle, and limiting an actual phase angle for controlling the electric valves in said specific cycle to said limiting value $\alpha_L$:

$$\alpha_L=\theta_1-(1/n)t_1$$

wherein $\theta_1$ and $t_1$ represent an ignition phase angle and a turn-off period respectively of said electric valve means in said immediately preceding cycle, and n is a positive integer equal to or less than 2.

2. A method for controlling AC power supplied from an AC power source to a load having a substantial amount of inductance through electric valve means, said method comprising the steps of calculating a limiting value $\alpha_L$ of a phase angle for igniting the electric valve means in a specific cycle of power source voltage according to the following equations based on the power source voltage and a turn-off period of the electric valves in the immediately preceding cycle of said specific cycle, and limiting an actual phase angle for controlling the electric valves in said specific cycle to said limiting value $\alpha_L$ $$\alpha_L=\beta_1+t_2$$

$$t_2=(\theta_1-\beta_1)/n$$

wherein $\theta_1$ and $\beta_1$ represent the ignition phase angle and a turn-off phase angle respectively of said electric valves in said immediately preceding cycle, $t_2$ represents the turn-off period of said electric valve means in said specific cycle, and n is a positive integer equal to or larger than 2.

3. An apparatus for controlling AC power supplied from an AC power source to a load having a substantial amount of inductance through electric valve means, said apparatus comprising means for detecting power source voltage and turn-off period of said electric valve means, means for calculating a limiting value $\alpha_L$ of a phase angle for igniting the electric valves in a specific cycle of the power source voltage from the following equation:

$$\alpha_L=\theta_1-(1/n)t_1$$

wherein $\theta_1$ and $t_1$ represent the ignition phase angle and the turn-off period, respectively, of said electric valve means in said immediately preceding cycle, and n is a positive integer equal to or less than 2, and an AND gate for receiving said $\alpha_L$ and another value of the ignition phase angle adapted to obtain a desired load current so as to deliver an ultimate ignition phase angle.

4. An apparatus for controlling AC power supplied from an AC power source to a load having a substantial amount of inductance through electric valve means, said apparatus comprising means for detecting power source voltage, turn-off period, and turn-off phase angle of said electric valve means, means for calculating a limit value $\alpha_L$ of a phase angle for igniting the electric valves in a specific cycle of the power source voltage from the following equations:

$$\alpha_L=\beta_1+t_2$$

$$t_2=(\theta_1-\beta_1)/n$$

wherein $\theta_1$ and $\beta_1$ represent the ignition phase angle and the turn-off phase angle respectively of said electric valves in said immediately preceding cycle, $t_2$ represents the turn-off period of said electric valve means in said specific cycle, and n is a positive integer equal to or larger than 2, and an AND gate for receiving said $\alpha_L$ and another value of the ignition phase angle adapted to obtain a desired load current so as to deliver an ultimate ignition phase angle.

* * * * *